United States Patent [19]

Braasch

[11] Patent Number: 4,991,071

[45] Date of Patent: Feb. 5, 1991

[54] LIGHT STRING SET

[75] Inventor: Robert J. Braasch, Northfield, Ill.

[73] Assignee: Noma International, Inc., Forest Park, Ill.

[21] Appl. No.: 339,409

[22] Filed: Apr. 14, 1989

[51] Int. Cl.[5] ..... F21V 21/00; H05B 37/00

[52] U.S. Cl. ..... 362/249; 362/806; 315/185 S

[58] Field of Search ..... 315/185 S, 185 R, 186; 362/249, 123, 435, 443, 448, 457, 806

[56] References Cited

U.S. PATENT DOCUMENTS

| | | | |
|---|---|---|---|
| 3,120,351 | 2/1964 | Kirsten | 362/123 |
| 4,667,276 | 5/1987 | Cheng | 362/249 |
| 4,816,977 | 3/1989 | Sorensen | 362/448 |

*Primary Examiner*—Eugene R. LaRoche
*Assistant Examiner*—Ali Neyzari
*Attorney, Agent, or Firm*—Kirschstein, Ottinger, Israel & Schiffmiller

[57] ABSTRACT

A Christmas light string set enables high volage, high wattage light bulbs to be inserted in a push-in manner into holders which are, in turn, assembled in a push-in manner into a socket.

4 Claims, 2 Drawing Sheets

LIGHT STRING SET

BACKGROUND OF THE INVENTION

1. Field of the Invention

This invention generally relates to a light string set and, more particularly, to push-in bulbs assembled into holders and sockets.

2. Description of Related Art

Light string sets are commonly used for adorning Christmas trees or as business displays. Bulbs rated at low voltage, e.g. less than 12 v, and at low power, e.g. less than 5 w, are known in the trade as "midget" bulbs and are inserted in a push-in manner into sockets arranged along an electrical cable that is plugged into an electrical outlet. Although the push-in midget bulbs are relatively inexpensive to manufacture and assemble, they do not emit as much light as higher wattage, e.g. greater than 5 w, and higher voltage, e.g. 120 v, bulbs. However, the higher wattage, higher voltage bulbs (known in the trade by the designation C-9 or C-7 bulbs) have a threaded base adapted to be threaded into a screw-in-type socket which renders the entire arrangement more expensive, both in terms of manufacture and assembly.

SUMMARY OF THE INVENTION

1. Objects of the Invention

It is a general object of this invention to overcome the drawbacks of the prior art of light string sets.

It is another object of this invention to insert high wattage, high voltage bulbs into sockets of a light string set in a push-in manner.

A further object of this invention is to decrease the cost of manufacture and assembly of light string sets.

2. Features of the Invention

In keeping with these objects, and others which will become apparent hereinafter, one feature of this invention resides, briefly stated, in a lamp assembly comprising a light bulb symmetrical about a longitudinal axis, a holder assembled to the bulb, and a socket for axially receiving the holder assembled to the bulb in a push-in manner.

The bulb includes a bulbous envelope having an interior base seal and an annular skirt extending axially beyond the base seal. A projection extends axially outwardly of the envelope from the base seal through and past the skirt. A filament is supported within the envelope by a pair of wire leads connected across the filament and extending from the base seal axially through and past the skirt.

The holder includes a husk for receiving the skirt. The husk has a base wall, a cylindrical part extending axially from the base wall, and a frustoconical part extending axially away from the cylindrical part and diverging in a direction away from the base wall. A tubular hollow sleeve is centrally located on the base wall, and has an interior axially-extending sleeve portion within the husk for receiving the projection and the wire leads, as well as an exterior axiallyextending sleeve portion outside of the husk for receiving the wire leads. A hollow key plug of non-circular cross-section extends axially away from the exterior sleeve portion. The key plug has curved side walls and a pair of apertures through which the wire leads pass and are bent into engagement with the curved side walls upon assembly of the holder to the bulb.

The socket includes a hollow, cylindrical entry portion for snugly receiving in friction-tight engagement the exterior sleeve portion. A hollow keyway of complementary contour to the key plug snugly receives in friction-tight engagement the key plug in a keyed relationship. A pair of spaced-apart electrical terminals are located within the keyway, and make respective electrical connections to the bent wire leads upon reception of the holder into the socket.

In accordance with this invention, the bulb is electrically rated for a minimum of 5 w and 120 v. This non-midget type bulb emits more light than conventional midget bulbs and yet does not require a screw-in type socket to complete the electrical connection. The push-in type connection for the non-midget bulbs renders the manufacture and assembly of light sting sets utilizing such lamp assemblies inexpensive.

A plurality of bulbs, holders and sockets identical to the first-mentioned bulb, holder and socket are spaced along, and interconnected to, an electrical cable and constitute a light string set which can be used to adorn Christmas trees or any business display stand.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE PREFERRED EMBODIMENT

Figure 1:
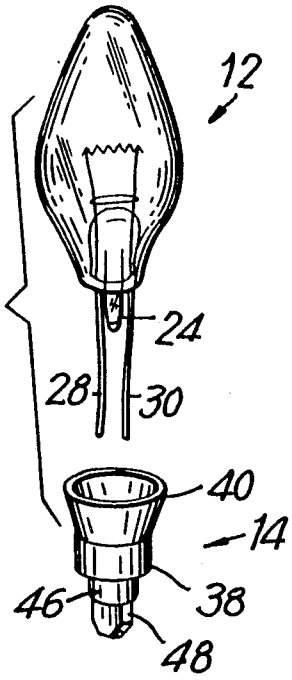
FIG. 1 is an exploded view of a light bulb and a holder therefor.
Figure 2:
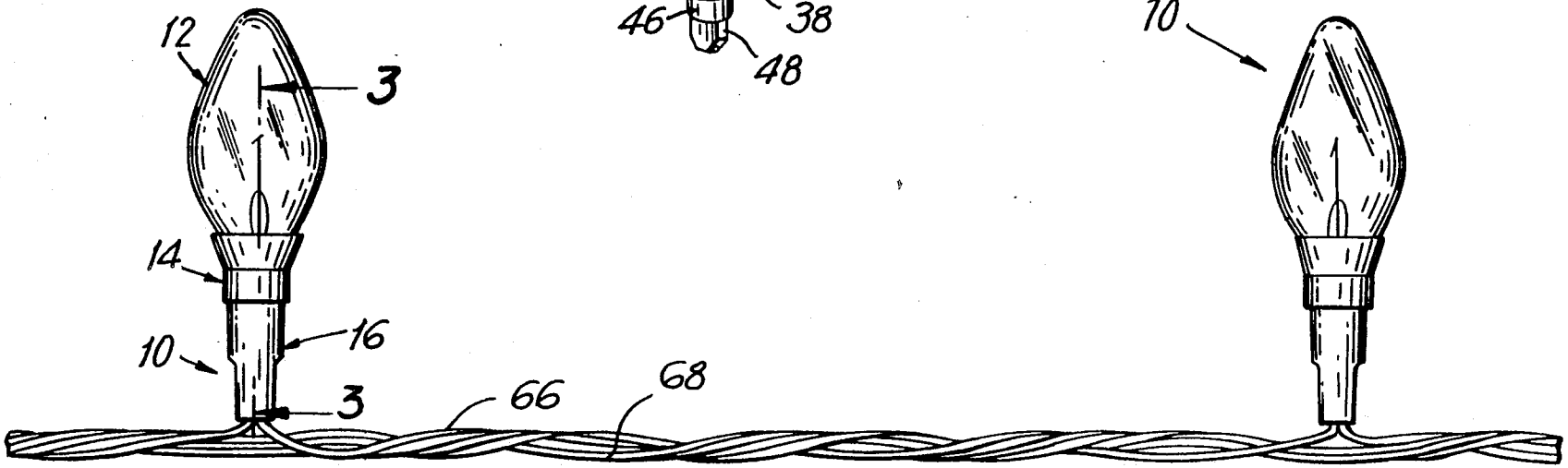
FIG. 2 is a broken-away view of a light string set with two interconnected lamp assemblies according to this invention.
Figure 3:
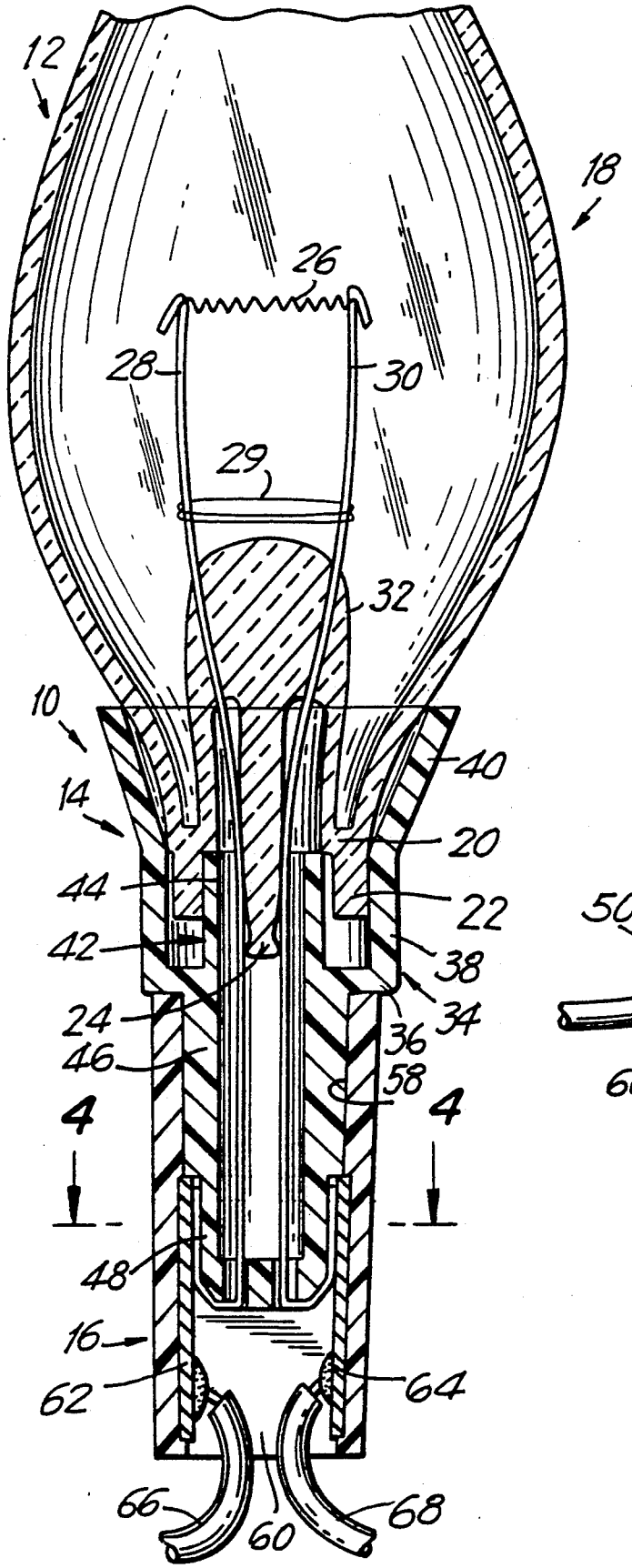
FIG. 3 is an enlarged sectional view taken on line 3—3 of FIG. 2.

As shown in FIG. 2, a lamp assembly 10 includes a light bulb 12, a holder 14 assembled to the bulb, and a socket 16 for receiving the holder in a push-in manner. As best shown in FIG. 3, the bulb 12 includes an envelope 18, preferably composed of transparent or colored glass, having an interior base seal 20 for vacuum-sealing the interior of the envelope. An annular skirt 22 extends in an axial direction below the base seal 20. A projection 24 integral with the envelope extends axially from the base seal through and past the skirt. An elongated filament 26 is mounted within the envelope and is supported at opposite ends thereof by a pair of conductive metallic wire leads 28, 30 which extend axially through, and are embedded in, at least partly along their lengths, in a central support 32 integral with the projection 24. A shunt 29 of conductive wire is connected across the wire leads 28, 30 in parallel with the filament 26.

The holder 14 includes a husk 34 of electrically insulating synthetic plastic material for receiving the skirt and the bottom of the bulb. The husk 34 includes a circular base wall 36, a cylindrical part 38 extending axially away from the base wall, and a frusto-conical flared part 40 extending axially away from the cylindrical part and diverging away from the same in a direction away from the base wall.

A tubular hollow sleeve 42 is centrally located on the base wall. The sleeve includes an interior axially-extending sleeve portion 44 within the husk for receiving the projection 24 and the wire leads 28, 30 upon assembly of the bulb to the holder. The sleeve further includes an exterior axially-extending sleeve portion 46 outside of the husk for receiving the wire leads 28, 30. The interior sleeve portion 44 and the exterior sleeve portion 46 are concentric with each other.

Figure 4:
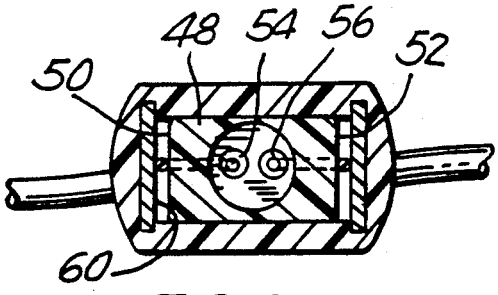
FIG. 4 is an enlarged cross-sectional view taken on line 4—4 of FIG. 3.

The holder further includes a hollow key plug 48 of non-circular cross-section (see FIG. 4) extending axially away from the exterior sleeve portion 46. The plug 48 has a pair of curved side walls 50, 52 and a pair of apertures 54, 56. The wire leads 28, 30 are passed through the apertures 54, 56 and are bent into engagement with the curved side walls 50, 52 upon assembly of the holder to the bulb.

The socket 16 includes a hollow cylindrical entry portion 58 for snugly receiving the exterior sleeve portion 46 in a friction-tight engagement. A hollow keyway 60 of complementary contour to the key plug 48 is formed within the socket for snugly receiving the plug in a friction-tight keyed relationship. A pair of spaced-apart electrical terminals 62, 64, preferably constituted of conductive metallic strips, are mounted within the keyway 60 and make electrical contact with the bent wire leads 28, 30 upon reception of the holder into the socket. An electrical cable, including conductors 66, 68, is electrically connected, e.g. by soldering, to the terminals 62, 64. The conductors 66, 68 constitute part of a light string set which, as shown in FIG. 2, includes a plurality of the aforementioned lamp assemblies.

In the preferred embodiment, each bulb is electrically rated for a minimum of 5 w and 120 v, and has a physical size known in the trade as C-7 or C-9. Although such large-sized bulbs have typically been provided with a threaded base for making a threaded connection with a screw-type socket, this invention proposes the use of a push-in plug/socket connection.

In order to assemble the above-described arrangement, each light bulb is first inserted into a respective holder by inserting the projection 24 and the wire leads 28, 30 into and through the interior sleeve portion 44. The wire leads, which continue through the exterior sleeve portion 46, are routed through the apertures 54, 56 and, thereupon, are bent into physical contact with the curved side walls of the plug 48. Thereupon, the holder is inserted into the socket, with the assembler making sure that the key plug 48 and the keyway 60 are in alignment. Upon full insertion of the holder the socket, the bent wire leads make electromechanical contact with the terminals 62, 64. When a source of electrical energy is supplied to the terminals by the conductor 66, 68, the filament 26 will be energized to light the lamp. Should the filament burn out, the shunt 29 will provide a by-pass path through which electrical current will flow to the next bulb in the string. To remove a burned-out bulb, one merely need grasp the holder 14 and pull it out of its respective socket 16. Thereupon, by firmly grasping the holder 14 and giving the envelope 18 a slight twist, the envelope can be removed from its respective holder.

It will be understood that each of the elements described above, or two or more together, also may find a useful application in other types of constructions differing from the types described above.

While the invention has been illustrated and described as embodied in a light string set, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A lamp assembly, comprising:

(A) a light bulb symmetrical about a longitudinal axis, and including (i) a bulbous envelope having an interior base seal and an annular skirt extending axially beyond the base seal, (ii) a projection extending axially from the base seal through and past the skirt, (iii) a filament within the envelope, and (iv) a pair of wire leads connected across the filament and extending axially from the base seal through and past the skirt;

(B) a holder assembled to the bulb, and including (i) a husk for receiving the skirt, said husk having a base wall, a cylindrical part extending axially from the base wall, and a frusto-conical part extending axially from the cylindrical part, (ii) a tubular, hollow sleeve centrally located on the base wall, said sleeve having an interior axially-extending sleeve portion within the husk for receiving the projection and the wire leads, and an exterior axially-extending sleeve portion outside of the husk for receiving the wire leads, and (iii) a hollow key plug of non-circular cross-section extending axially away from the exterior sleeve portion, said key plug having curved side walls and a pair of apertures through which the wire leads pass and are bent into engagement with the curved side walls upon assembly of the holder to the bulb; and (C) a socket for axially receiving the holder assembled to the bulb in a push-in manner, and including (i) a hollow, cylindrical entry portion for snugly receiving the exterior sleeve portion, (ii) a hollow keyway of complementary contour to the key plug for snugly receiving the same in a keyed relationship, and (iii) a pair of spaced-apart electrical terminals within the keyway and making respective electrical connections to the bent wire leads upon reception of the holder into the socket.

2. The lamp assembly as recited in claim 1, wherein the bulb is electrically rated for a minimum of 5 watts and 120 volts.

3. The lamp assembly as recited in claim 1, wherein the holder and the socket are constituted of an electrically-insulating material.

4. The lamp assembly as recited in claim 1; and further comprising a plurality of bulbs, holders and sockets identical to the first-mentioned bulb, holder and socket and interconnected along electrical conductors to constitute a light string set.

* * * * *